US010314136B2

(12) United States Patent
Wang et al.

(10) Patent No.: US 10,314,136 B2
(45) Date of Patent: Jun. 4, 2019

(54) TRAFFIC LIGHT DRIVING CONTROL CIRCUIT

(71) Applicants: LITE-ON ELECTRONICS (GUANGZHOU) LIMITED, Guangzhou (CN); LITE-ON TECHNOLOGY CORPORATION, Taipei (TW)

(72) Inventors: Shih-Chang Wang, New Taipei (TW); Ching-Tsung Ni, Taoyuan (TW); Chien-Lung Wang, Taichung (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 205 days.

(21) Appl. No.: 15/243,064

(22) Filed: Aug. 22, 2016

(65) Prior Publication Data

US 2017/0094747 A1 Mar. 30, 2017

Related U.S. Application Data

(60) Provisional application No. 62/232,535, filed on Sep. 25, 2015.

(51) Int. Cl.

| | |
|---|---|
| ***H05B 33/08*** | (2006.01) |
| ***H05B 37/02*** | (2006.01) |
| *G08G 1/095* | (2006.01) |

(52) U.S. Cl.

CPC ..... *H05B 33/0887* (2013.01); *H05B 33/0809* (2013.01); *H05B 33/0842* (2013.01); *H05B 37/02* (2013.01); *G08G 1/095* (2013.01)

(58) Field of Classification Search

CPC ..... H05B 33/0809; H05B 33/0815; H05B 33/0845; H05B 33/0887; H05B 33/089;

(Continued)

(56) References Cited

U.S. PATENT DOCUMENTS 6,150,771 A * 11/2000 Perry ..... H05B 33/0818 315/129
2005/0206529 A1* 9/2005 St.-Germain ..... B61L 5/1881 340/815.45

(Continued)

*Primary Examiner* — Douglas W Owens
*Assistant Examiner* — Amy X Yang
(74) *Attorney, Agent, or Firm* — Li & Cai Intellectual Property (USA) Office

(57) ABSTRACT

Disclosed is a drive integrated circuit for controlling a traffic light. The drive IC comprises an input end and an output end, an input low-voltage control circuit, a gain control circuit, a driving circuit, an impedance loop and a phase detection circuit. The input low-voltage control circuit connects to the input end of the drive IC, and receives a first external signal. The gain control circuit connects to the input low-voltage control circuit. The driving circuit connects to the gain control circuit. The impedance loop connects to the input end to detect whether the traffic light is damaged. The phase detection circuit connects to the input end to detect a phase difference of the driving signal. By integrating circuits having different detection and control functions in one single chip, the cost of the drive IC decreases and the traffic light can have a less thick structure.

8 Claims, 2 Drawing Sheets

(58) Field of Classification Search
CPC ..... H05B 33/0842; H05B 33/0851; H05B 37/03; H05B 39/044; H05B 41/3924
USPC ..... 315/127, 291
See application file for complete search history.

(56) References Cited

U.S. PATENT DOCUMENTS

2009/0315480 A1* 12/2009 Yan ..... H05B 33/0815 315/297
2013/0257284 A1* 10/2013 VanWagoner ..... H05B 37/0245 315/131

* cited by examiner

TRAFFIC LIGHT DRIVING CONTROL CIRCUIT

BACKGROUND OF THE INVENTION

1. Field of the Invention

The instant disclosure relates to a drive integrated circuit (drive IC); in particular, to a drive IC having many circuits comprising different functions integrated for driving and controlling a traffic light.

2. Description of Related Art

For a traditional driving circuit of a traffic light, when different functions are required, new circuits need to be designed and they should be able to be applied to an original core circuit. Moreover, the original core circuit can only execute certain detections and controls by itself. There are some detection functions and some control functions that cannot be directly executed by the drive IC and thus new circuits need to be designed. The newly designed circuits should be able to be applied to the original core circuit, because it is the drive IC that drives them to execute their functions (e.g., a detection function or a control function). However, in this manner, the entire driving circuit of the traffic light is complex and has a big volume, which results in an increase of cost and a difficulty for the management of the circuit elements, and thus the quality of the traffic light suffers.

SUMMARY OF THE INVENTION

The instant disclosure provides a drive integrated circuit (drive IC) for a controlling traffic light, such as a LED traffic light. Many circuits having different functions for driving or controlling the traffic light are all integrated in one single chip, and in this way less circuit elements are used. Using less circuit elements makes the element management become easier and decreases the element cost, and as a result the product quality is effectively improved. Moreover, using less circuit elements makes the traffic light have a less thick structure.

The drive integrated circuit for controlling a traffic light comprises an input end and an output end, an input voltage detection circuit, a gain control circuit, a driving circuit, an impedance loop and a phase detection circuit. The input voltage detection circuit is connected to the input end of the drive integrated circuit. The input voltage detection circuit receives a first external signal to determine whether an input voltage of the traffic light is too low. The drive integrated circuit is shut down if the input voltage of the traffic light is too low. The gain control circuit is connected to the input voltage detection circuit to control the gain of an output end of the input voltage detection circuit. The driving circuit is connected to the gain control circuit, and outputs at least one driving signal. An output end of the driving circuit is the output end of the drive integrated circuit. The impedance loop is connected to the input end of the integrated circuit to detect whether the traffic light is damaged. The phase detection circuit is connected to the input end of the integrated circuit. The phase detection circuit receives a second external signal to obtain and provide a phase difference between the input voltage of the traffic light and the second external signal to the gain control circuit as a reference. The second external signal provides a determined output illumination of the traffic light. A rectifier is connected to the input end of the drive integrated circuit to provide a power supply.

A load is connected to the output end of the drive integrated circuit, and the load is the traffic light comprising a LED lamp set.

In one embodiment of the drive IC for controlling a traffic light, the first external signal provides a determined low voltage. When the input voltage of the traffic light is lower than the determined low voltage provided by the first external signal, the gain control circuit shuts down the driving circuit and the load is not driven. At the same time, the gain control circuit protection control circuit is shut down and the impedance loop is driven, such that the impedance of the traffic light is low and an external traffic light controller can determine whether the traffic light is damaged.

In one embodiment of the drive IC for controlling a traffic light, the second external signal provides the determined output illumination. The gain control circuit controls the driving circuit to adjust the illumination of the traffic light according to the determined output illumination provided by the second external signal.

In one embodiment of the drive IC for controlling a traffic light, the drive IC further comprises a load current/voltage detection circuit and a protection control circuit. The load current/voltage detection circuit is connected to the driving circuit, and detects an output voltage and an output current of the drive integrated circuit. The protection control circuit is connected to the load current/voltage detection circuit and the input voltage detection circuit. The protection control circuit receives a third external signal that provides threshold values of the output voltage and the output current of the drive integrated circuit. Also, the protection control circuit determines whether the output current of the drive integrated circuit are larger than or lower than their corresponding threshold values to further determine whether to execute a protection mechanism. When the output current of the drive integrated circuit are larger than or lower than their corresponding threshold values provided by the third external signal, the protection control circuit executes the protection mechanism by turning on a switching circuit. The switching circuit is connected to the protection control circuit and the rectifier of the drive integrated circuit. By turning on a switching circuit, the drive integrated circuit is shut down to protect the traffic light.

In one embodiment of the drive IC for controlling a traffic light, the protection control circuit receives the third external signal.

For further understanding of the instant disclosure, reference is made to the following detailed description illustrating the embodiments of the instant disclosure. The description is only for illustrating the instant disclosure, not for limiting the scope of the claim.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF PREFERRED EMBODIMENTS

The instant disclosure relates to a drive integrated circuit (Drive IC) for a controlling traffic light, such as LED traffic lights. Many circuits having different functions for driving or controlling traffic lights are all integrated in one single chip, and in this way less circuit elements will be used.

Figure 1:
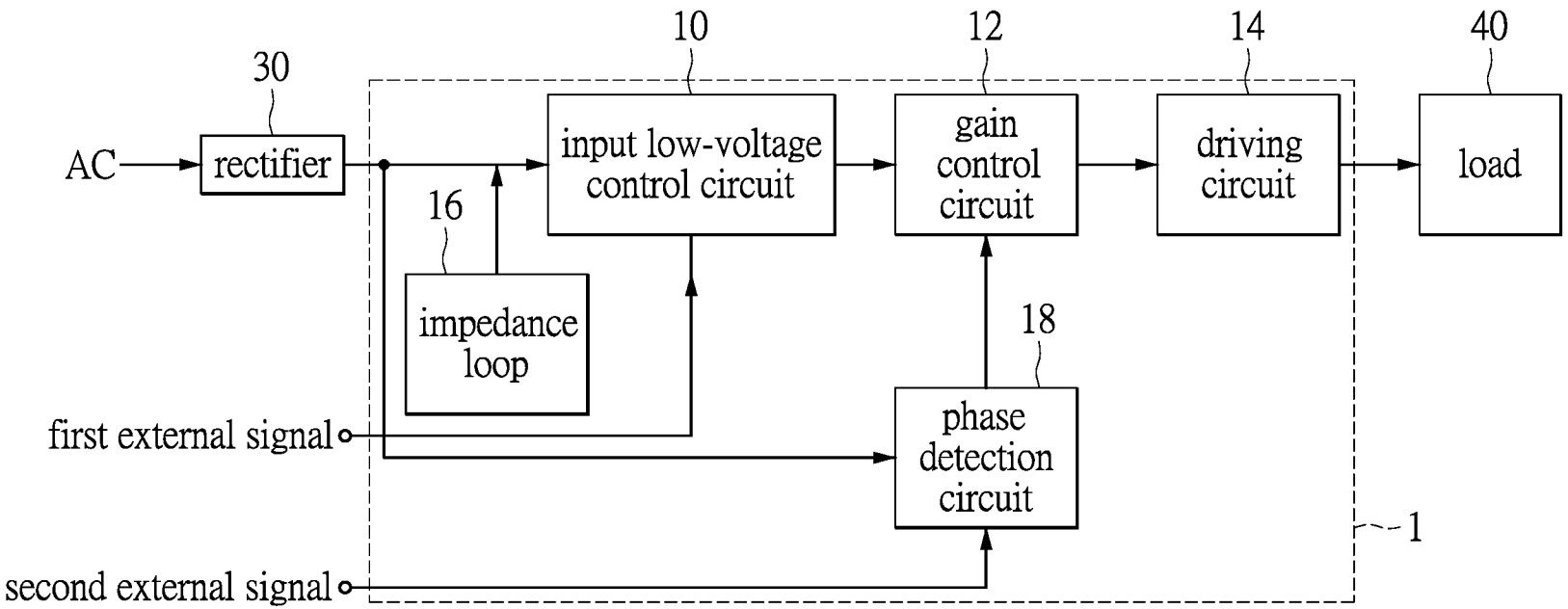
FIG. 1 shows a block diagram of a drive IC for controlling a traffic light of the first embodiment of the instant disclosure.

Referring to FIG. 1, FIG. 1 shows a block diagram of a drive IC for controlling a traffic light of the first embodiment of the instant disclosure. As shown in FIG. 1, an input end of the drive IC 1 for controlling a traffic light is connected to a rectifier 30. The rectifier 30 receives and rectifies an AC power source and transmits the rectified current to the drive IC 1. An output end of the drive IC 1 is connected to a load 40, and the load 40 will be driven by the drive IC 1. The load 40 can be an LED illumination module, an LED light string, many lamp sets that are in serial, an LED lamp module or the like, but it is not limited herein. The rectifier 30 can be a full-bridge rectifier, a half-bridge rectifier, a center-tapped full-bridge rectifier or the like, but it is also not limited herein. Moreover, the AC power source can be a utility power. The drive integrated circuit having circuits having different functions for driving or controlling traffic lights which are all integrated in one single chip is the drive IC 1.

The drive IC 1 for controlling traffic lights comprises an input low-voltage control circuit 10, a gain control circuit 12, a driving circuit 14, an impedance loop 16 and a phase detection circuit 18. An input end of the input low-voltage control circuit 10, which is just the input end of the drive IC 1, is connected to the rectifier 30, and another input end of the input low-voltage control circuit 10 receives a first external signal. The first external signal provides a determined low voltage. The input low-voltage control circuit 10 detects whether the input voltage of the traffic light is too low. If the input voltage of the drive integrated circuit is lower than the determined low voltage provided by the first external signal, it indicates that the traffic light needs to be turned off, so as to prevent the traffic light works abnormally because of being driven by a low input voltage.

An output end of the input low-voltage control circuit 10 is connected to the gain control circuit 12. An output end of the gain control circuit 12 is connected to the driving circuit 14. The gain control circuit 12 controls the gain of the entire drive IC 1 or the gain of the output of the drive IC 1. Moreover, the gain control circuit 12 can adjust the gain of each circuit in the drive IC 1 for the driving circuit 14. The driving circuit 14 is connected to a load 40, and outputs a driving signal to drive the load 40, for example, to turn on the LED lamp set. The gain control circuit 12 is connected to the driving circuit 14, such that the driving circuit 14 can linearly increase the driving current of the traffic light, such as LED lamp sets that are in serial. In this manner, when the input voltage of the drive IC varies, the driving circuit 14 can determine how many LED lamp sets can be driven.

The impedance loop 16 is connected to the node connecting the input low-voltage control circuit 10 and the rectifier 30. The node connecting the input low-voltage control circuit 10 and the rectifier 30 is just the input end of the drive IC 1. In this manner, the impedance loop 16 helps an external traffic light controller to determine whether the traffic light is damaged even when the power supply is cut. The traffic light controller determines that the traffic light is damaged if the impedance loop 16 detects that the impedance at the output end of the rectifier 30 is high. For example, when the LED lamp set is damaged or the fuse is burned out, the drive IC 1 turns into an open circuit and thus the equivalent resistance measured at the output of the rectifier 30 will be very large. On the contrary, the traffic light controller determines that the traffic light is not damaged if the impedance loop 16 detects that the impedance at the output end of the rectifier 30 is low. The impedance loop 16 integrated in the drive IC 1 can provide an impedance detection function for helping the traffic light controller to determine whether the traffic light is not damaged An input end of a phase detection circuit 18 is connected to the input end of the drive IC 1, and another input end of the phase detection circuit 18 receives a second external signal. An output end of the phase detection circuit 18 is connected to the gain control circuit 12. The phase detection circuit 18 detects a phase difference between the input voltage of the traffic light and the second external signal. The gain control circuit 12 adjust the input voltage and the input current of the driving circuit 14 according to the phase difference, so that the phases of the input voltage and the input current of the driving circuit 14 will not change. In another embodiment, the second external signal provides a predetermined output of the driving circuit 14 to the gain control circuit 12 as a reference, so that the traffic light driven by the driving circuit 14 can have a constant illumination even the input voltage of the drive IC 1 varies.

Figure 2:
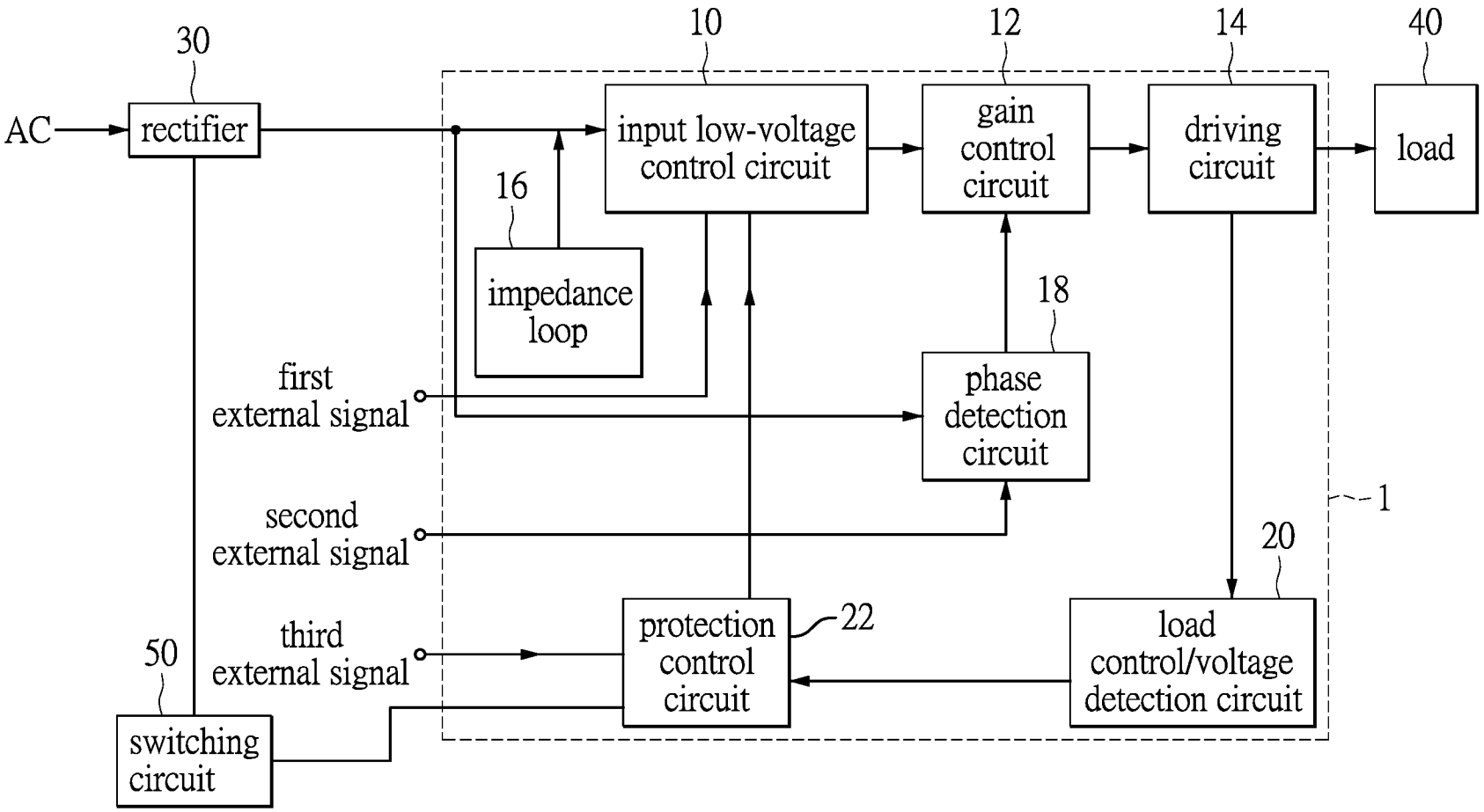
FIG. 2 shows a block diagram of a drive IC for controlling a traffic light of the second embodiment of the instant disclosure.

Referring to FIG. 2, FIG. 2 shows a block diagram of a drive IC for controlling a traffic light of the second embodiment of the instant disclosure. The difference between the drive IC 1 shown in FIG. 1 and the drive IC 1 in this embodiment is that the drive IC 1 in this embodiment further comprises a load current/voltage detection circuit 20 and a protection control circuit 22. Moreover, a switching circuit 50 is connected to the drive IC 1, and the drive IC 1 further receives a third external signal. An input end of the load current/voltage detection circuit 20 is connected to the driving circuit 14, and an output end of the load current/voltage detection circuit 20 is connected to the protection control circuit 22. The load current/voltage detection circuit 20 detects the voltage and the current of the load 40. The protection control circuit 22 is connected to the input low-voltage control circuit 10 and the switching circuit 50, and receives the third external signal. The switching circuit 50 is connected to the rectifier 30.

The load current/voltage detection circuit 20 detects the voltage and the current of the load 40. When the voltage or the current of the load 40 is too large or too small, specifically speaking, when the voltage or the current of the load 40 is larger or smaller than a threshold value provided by the third external signal, the protection control circuit 22 further determines whether the input voltage of the drive IC 1 is lower than the low-voltage signal. According to the determination about whether the voltage or the current of the load 40 is larger or smaller than a threshold value provided by the third external signal, and the determination about whether the input voltage of the drive IC 1 is lower than the low-voltage signal, the protection control circuit 22 determines whether to execute a protection mechanism to turn on the switching circuit 50 for shutting down the traffic light.

The switching circuit 50 is configured outside the drive IC 1, and is connected to the protection control circuit 22 of the drive IC 1 and the rectifier 30. The switching circuit 50 can control the rectifier 30 to shut down the entire drive IC 1. Alternatively, the protection control circuit 22 can transmit a signal to turn on the switching circuit 50, and then the switching circuit 50 controls the rectifier 30 to shut down the drive IC 1 for protecting the traffic light.

The impedance loop 16, the input low-voltage control circuit 10 and the phase detection circuit 18 of the drive IC 1 in this embodiment have the same connection relationship and the same working mechanism as the impedance loop 16, the input low-voltage control circuit 10 and the phase detection circuit 18 of the drive IC 1 shown in FIG. 1.

The drive IC for controlling a traffic light provided by the instant disclosure at least has the following advantages:

1. It can decrease the volume of the traffic light because less circuit elements need to be used, which further makes the cost go down.

2. Compared with a traditional driving circuit for driving the traffic light, 70% of the needed circuit elements can be removed, which makes the management of the circuit elements easier.

3. The cost of the traffic light using the drive IC provided by the instant disclosure can be only 85% of the cost of a traditional traffic light, which is more competitive.

4. It has a simplified core circuit, and allows the light source elements of the traffic light and the circuit elements of the drive IC to be co-designed.

5. Common circuit elements can be designed together, which can be applied to a wide voltage range from 12V to 277V.

6. It can directly drive the load, such as a LED light source, with many different kinds of external controllers.

7. It can detect the input voltage and determines whether to drive the load or protect the load according to different external signals.

8. When the drive IC does not work, its internal resistance is low, such that an external controller determines that the traffic light is not damaged, and the traffic light will not be suddenly turned on due to a great leakage current.

9. It can detect the variation of the voltage or the current of the load, and further determine the driving signal according to the external signals.

10. It can detect the voltage or the phase difference of the driving circuit, and further adjust the output gain according to the external signals to control the illumination of the load.

To sum up, the drive IC for controlling a traffic light provided by the instant disclosure has a less cost, and makes the management of the circuit elements easier, which can thus improve the quality of the traffic light. Moreover, using less circuit elements makes the traffic light have a less thick structure, in other words, a smaller volume. The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A drive integrated circuit for controlling a traffic light, comprising:

an input end and an output end;

an input voltage detection circuit, connected to the input end of the drive integrated circuit and receiving a first external signal to determine whether an input voltage of the traffic light is too low, wherein the drive integrated circuit is shut down if the input voltage of the traffic light is lower than a voltage determined by the first external signal;

a gain control circuit, connected to the input voltage detection circuit to control the gain of an output end of the input voltage detection circuit;

a driving circuit, connected to the gain control circuit, outputting at least one driving signal, wherein an output end of the driving circuit is the output end of the drive integrated circuit;

an impedance loop, connected to the input end of the integrated circuit to detect whether the traffic light is damaged;

a phase detection circuit, connected to the input end of the integrated circuit and receiving a second external signal to obtain and provide a phase difference between the input voltage of the traffic light and the second external signal to the gain control circuit as a reference, wherein the second external signal provides a determined output illumination of the traffic light;

a load current/voltage detection circuit, connected to the driving circuit, detecting an output voltage and an output current of the drive integrated circuit; and a protection control circuit, connected to the load current/voltage detection circuit and the input voltage detection circuit, receiving a third external signal that provides threshold values of the output voltage and the output current of the drive integrated circuit, and determining whether the output current of the drive integrated circuit are larger than or lower than their corresponding threshold values to further determine whether to execute a protection mechanism;

wherein a rectifier is connected to the input end of the drive integrated circuit to provide a power supply, a load is connected to the output end of the drive integrated circuit, and the load is the traffic light comprising a LED lamp set.

2. The drive integrated circuit for controlling a traffic light according to claim 1, wherein the first external signal provides a determined low voltage, and the gain control circuit shuts down the driving circuit when the input voltage of the traffic light is lower than the determined low voltage provided by the first external signal.

3. The drive integrated circuit for controlling a traffic light according to claim 1, wherein the gain control circuit takes the determined output illumination of the traffic light provided by the second external signal as a reference to control the driving circuit, such that the traffic light illuminates according to the determined output illumination provided by the second external signal.

4. The drive integrated circuit for controlling a traffic light according to claim 1, wherein the impedance loop detects whether the traffic light is damaged even when the power supply is cut, the traffic light is damaged if the impedance loop determines that the impedance of an output end of the rectifier is large if the traffic light is damaged, and the traffic light is not damaged if the impedance loop determines that the impedance of the output end of the rectifier is small.

5. The drive integrated circuit for controlling a traffic light according to claim 1, wherein the traffic light illuminates according to the determined output illumination provided by the second external signal and the phase difference between the input voltage of the traffic light and the second external signal.

6. The drive integrated circuit for controlling a traffic light according to claim 1, wherein a switching circuit is connected to the protection control circuit and the rectifier of the drive integrated circuit, when it is determined to execute the protection mechanism, the protection control circuit controls the switching circuit to shut down the drive integrated circuit, such that the impedance loop determines that the impedance of the output end of the rectifier is large and thus an external traffic controller determines that the traffic light is damaged and alerts the passerby.

7. The drive integrated circuit for controlling a traffic light according to claim 1, wherein when the temperature of the load, the driving circuit or the drive integrated circuit is so high that the output voltage or the output current of the drive integrated circuit is abnormal, the protection control circuit executes the protection mechanism.

8. The drive integrated circuit for controlling a traffic light according to claim 1, wherein the third external signal provides the threshold values of the output voltage and the output current of the drive integrated circuit to the protection control circuit to determine whether to execute the protection mechanism.

* * * * *